United States Patent [19]

Wyse

[11] Patent Number: 5,022,490

[45] Date of Patent: Jun. 11, 1991

[54] SAFETY BASE FOR SCAFFOLDING

[75] Inventor: Steven J. Wyse, Archbold, Ohio

[73] Assignee: Bil-Jax, Inc., Archbold, Ohio

[21] Appl. No.: 475,904

[22] Filed: Feb. 6, 1990

[51] Int. Cl.[5] ..... E04G 5/02

[52] U.S. Cl. ..... 182/17; 182/63; 182/204; 182/179

[58] Field of Search ..... 182/17, 63, 127, 178, 182/179, 200, 201, 204

[56] References Cited

U.S. PATENT DOCUMENTS

| | | | |
|---|---|---|---|
| 3,438,459 | 4/1969 | Magee | 182/179 |
| 4,216,933 | 8/1980 | Cramer | 182/179 |
| 4,423,797 | 1/1984 | Batten | 182/204 |
| 4,457,397 | 7/1984 | Scala | 182/200 |
| 4,620,608 | 11/1986 | Gilbreath | 182/178 |

*Primary Examiner*—Reinaldo P. Machado

*Attorney, Agent, or Firm*—Allen D. Gutchess, Jr.

[57] ABSTRACT

A safety base is provided for a scaffold. The scaffold has casters so that it can be moved periodically at the job site. The safety base has two components, each consisting of an elongate bar with adjustable safety legs near the ends, along with detachable locks for readily attaching the component to frame members of the scaffolding. Feet of the legs are positioned near the supporting surface so that if the casters encounter a depression as the scaffold is being moved, the feet will engage the surface and the scaffold will not tilt excessively.

13 Claims, 2 Drawing Sheets

SAFETY BASE FOR SCAFFOLDING

This invention relates to a detachable safety base for a scaffold.

Scaffolds are sometimes equipped with casters so that they can be moved along the floor periodically at a job site. This may occur, for example, when workmen are hanging fixtures and the scaffold is moved from time-to-time. The scaffold is pushed along by personnel on the ground. If one or more of the casters encounters a depression on the surface of the floor, such as a manhole, the scaffold may tilt excessively and tip over, with disastrous results. To overcome this problem, the scaffold can be equipped with safety legs near the casters, with lower ends or pads located just above the floor and which engage the floor if a caster wheel drops into a hole, thus helping prevent excessive tilting or tipping of the scaffold.

A safety base including safety legs in accordance with the invention can be quickly attached to and detached from a scaffold. This enables the safety base to be used only with a selected scaffold when or where needed since it is not part of the scaffold. It also greatly facilitates transportation of the scaffold components to and from a job site.

The safety base in accordance with the invention includes two base components, each of which is easily affixed to and detached from lower frame members of the scaffold. Each of the components includes a main elongate rigid member or bar which is long enough to extend between end frame members of the scaffold. A shorter elongate member or bar is affixed to one end of the main elongate member and extends transversely therefrom with a second, similar short member or bar at the other end of the main member. A first upright tube is affixed to the main member near one end thereof with a second tube similarly located near the other end. In a preferred form an upright tube is also affixed to each of the shorter members. Adjustable safety legs, each including a shank and a foot, are received in the tubular members and can be adjusted vertically to be located near the ground to meet the particular requirements of the particular scaffold with which the component is used. A lock or catch is also located at each end of the main elongate member by means of which the component can be readily attached to and detached from frame members of the end frames of the scaffold. With this arrangement, the safety base can be attached to the scaffold after it is transported in knocked-down condition to the work site and can be readily removed when the scaffold is to be transported from the work site.

It is, therefore, a principal object of the invention to provide a safety base for a scaffold which can be readily attached thereto and detached therefrom.

Another object of the invention is to provide a safety base for a scaffold which comprises two components, each of which can be readily attached to and detached from end frame members of the scaffold.

A further object is to provide a safety base which can be used with scaffolding of different designs and sizes.

Many other objects and advantages of the invention will be apparent from the following detailed description of a preferred embodiment thereof, reference being made to the accompanying drawings, in which.

Figure 1:
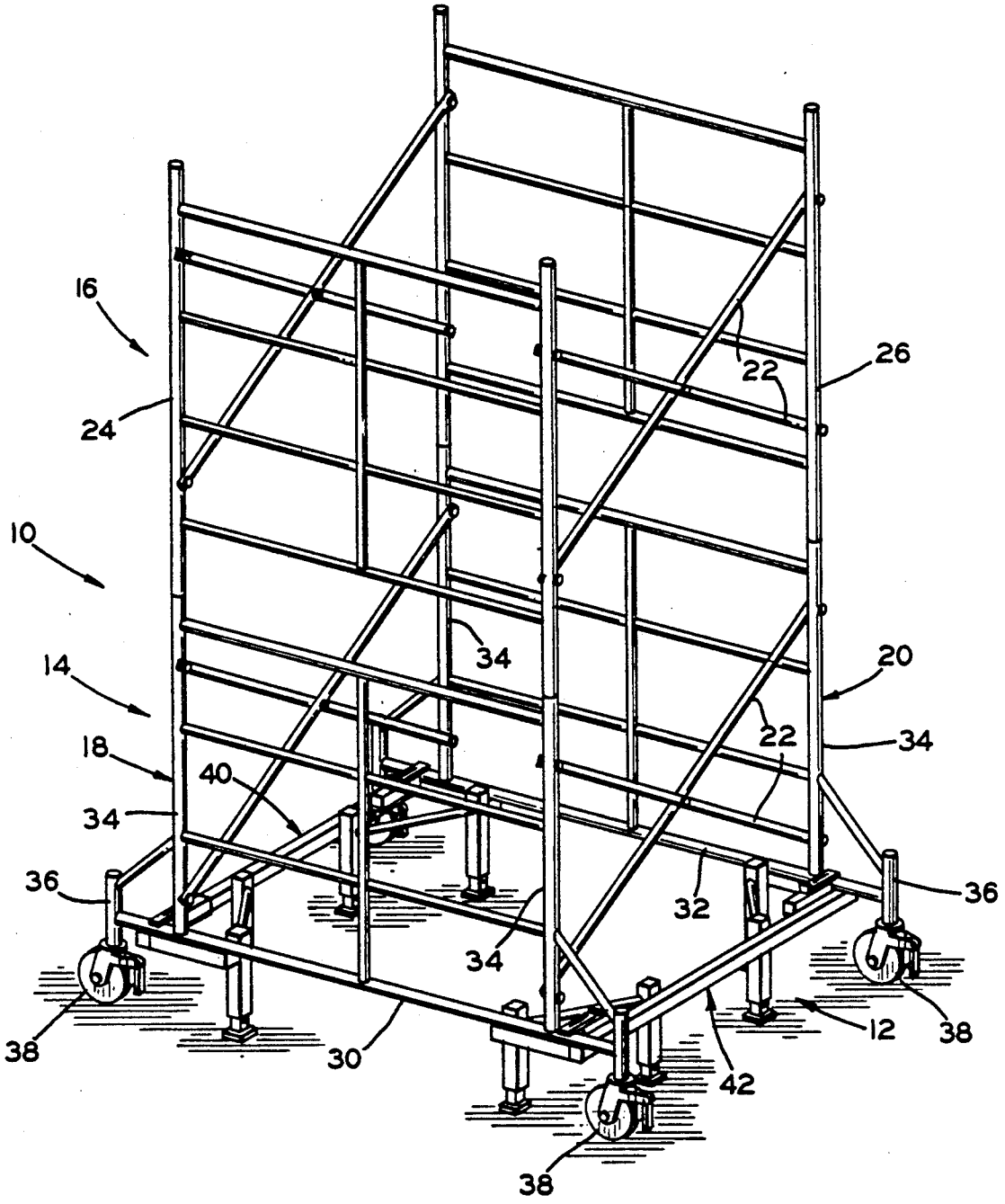
FIG. 1 is a somewhat schematic view in perspective of a scaffold with an attached safety base in accordance with the invention.

Referring to the drawings, and more particularly to FIG. 1, a scaffold 10 is shown employed with a safety base 12 in accordance with the invention. The scaffold 10 is of the rolling tower type which can be periodically moved at a job site, as needed. For example, when workmen are hanging fixtures, the rolling tower scaffold can be moved along the floors from time-to-time as the fixtures are hung. The scaffold can also be moved along a wall being painted, as needed. The scaffold is usually pushed along the floor or other supporting surface by personnel on the floor. Should one of the casters of the rolling tower encounter a depression, such as a manhole or a pit, the tower can tilt excessively, posing a real danger and the entire tower may tip over. To overcome this problem, supporting legs can be provided at the bottom of the scaffold positioned just above the floor. Should one of the casters drop into a depression, the legs thus minimize leaning of the tower.

The scaffold 10 includes a lower section 14 and one or more upper sections 16, only one being shown. In this instance, the lower section 14 includes end frames 18 and 20 with cross braces 22. The upper section 16 includes end frames 24 and 26 with cross braces 22. The lower frames 18 and 20 differ from the upper ones in that they have longer lower frame members 30 and 32 which extend outwardly beyond vertical frame members 34 to provide wider support. Upright tubes 36 at the ends of the lower frame members 30 and 32 pivotally receive casters 38. These are commercially available and have locks which hold the caster wheels from rotating when the scaffold 10 is in a desired position. However, the casters 38 also can be pivotally received in the lower ends of the vertical frame members 34 when the lower frame members 30 and 32 do not extend beyond the vertical members.

Figure 2:
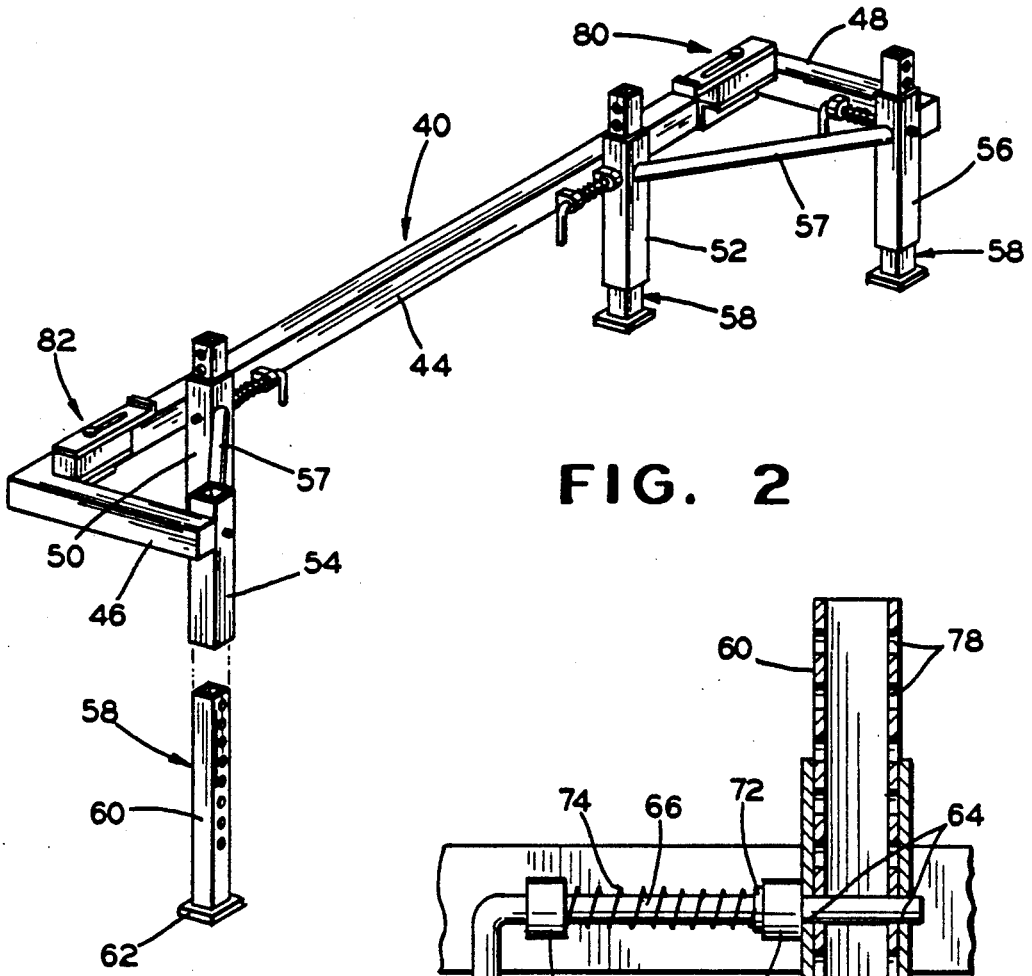
FIG. 2 is a view in perspective of one component of the safety base of FIG. 1.

The safety base 12 in accordance with the invention comprises two separate components 40 and 42 which are identical and interchangeable. Referring to FIG. 2, each of the base components 40 and 42 includes an elongate rigid member or bar 44 which is of a length sufficient to extend between the lower frame members 30 and 32 of the end frames 18 and 20. A first, shorter elongate rigid member or bar 46 is affixed to one end of the member 44 and extends transversely therefrom. Similarly, a second, shorter elongate rigid member or bar 48 is affixed to the other end of the member 44 and extends transversely therefrom in the same direction as the member 46. A first upright tubular member 50 of square cross section is affixed to the main member 44 near one end thereof and a second upright tubular member 52 is affixed to the main member 44 near the other end thereof. A third upright tubular member 54 preferably is affixed to the short rigid member 46 near the free end thereof and a fourth upright tubular member 56 is preferably affixed to the short rigid member 48 near the free end thereof. Diagonal struts 57 extend between the tubes 50, 54 and 52, 56 for additional support. Each of the tubular members 50–56 receives a safety leg or pedestal 58, each of which includes a shank 60 of square cross section and a foot 62, which can have a rubber pad thereon.

Figure 3:
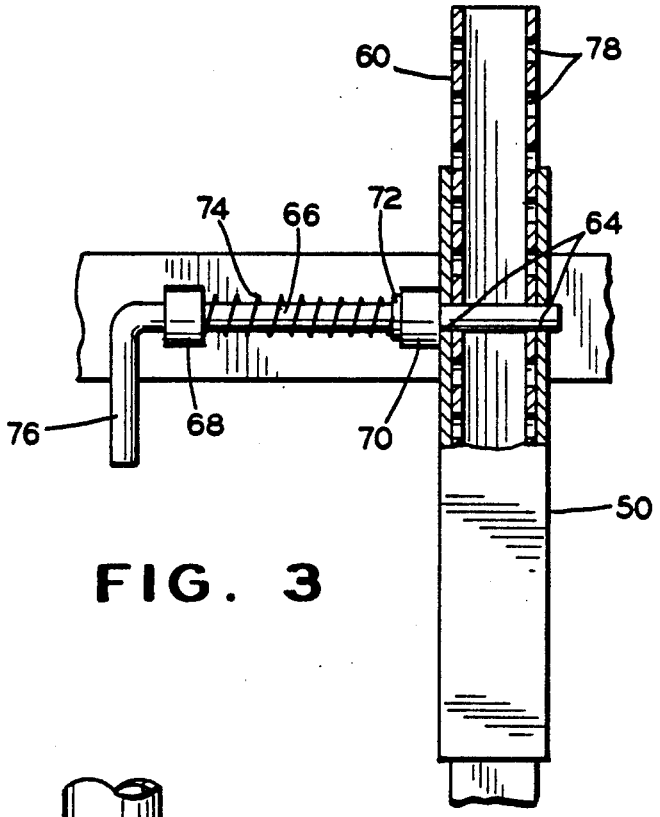
FIG. 3 is a detailed view in elevation, with parts broken away and with parts in cross section, of an adjustable safety leg of the safety base components.

The upright tubular member 50 as shown in FIG. 3 includes two aligned holes 64 in opposite side walls through which a locking pin 66 can extend. The pin 66 is slidably supported in guide eyes 68 and 70 which are affixed to the main rigid member 44 at one side wall thereof. The pin 66 has a flange or shoulder 72 between the guide eyes and a spring 74 is located between the flange 72 and the guide eye 68 to urge the locking pin 66 toward the extended, locking position, as shown in FIG. 3. The locking pin 66 terminates in a transversely extending handle 76. The safety leg shank 60 has a plurality of aligned, uniformly spaced holes 78 in opposite side walls thereof through two of which the locking pin 66 extends when it also extends through the holes 64 in the upright tube 50, as shown in FIG. 3. This adjusting means enables the shank 60 to be placed in a plurality of predetermined positions relative to the tube 50 so that the safety leg feet can be positioned roughly an inch above the ground when the component 40 is attached to any particular scaffold. This enables the safety base to accommodate scaffolds of various sizes and designs.

Figure 4:
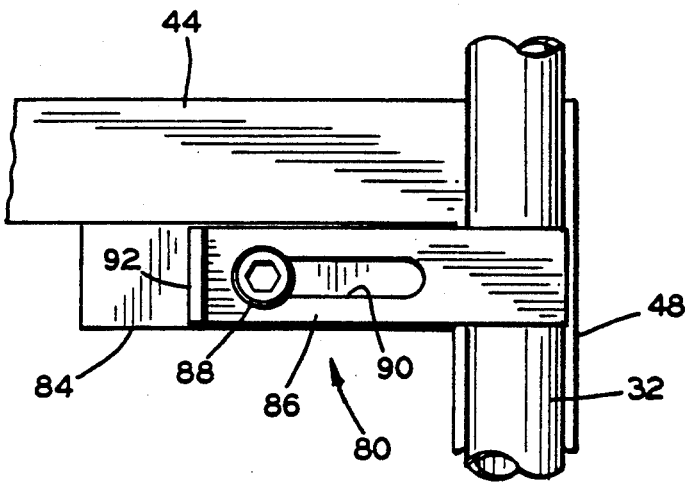
FIG. 4 is a detailed plan view of an attaching element of the safety base component.

Attachable locking means or clips 80 and 82 (FIG. 2) are located at the ends of the base component 40 and specifically at the ends of the main elongate rigid member 44. Each of these includes a support 84 (FIG. 4) which is affixed to the end of the member 44 and has a slide bar 86 located thereabove. The bar 86 is slidably connected to the support 84 by a suitable shoulder screw 88 or the like which extends through a slot 90 in the slide bar 86. The slide bar 86 has an end flange 92 by means of which the slide bar 86 can be pushed out over the lower end frame member 32. The support 84 and the slide bar 86 are positioned so that the bar moves with a force fit over the frame member 32 to securely hold the frame member between the slide bar 86 and the top surface of the short rigid member 84, in this instance. Should the slide bar 86 become unlocked, one end of the component 40 will drop down slightly until the feet 62 of the safety legs 58 contact the ground. This will be noticed by the workmen moving the scaffold but even if not, the end of the component 40 will support the end frame 20 of the scaffold should the caster drop into a depression or hole while the scaffold is being moved.

Various modifications of the above-described embodiment of the invention will be apparent to those skilled in the art, and it is to be understood that such modifications can be made without departing from the scope of the invention, if they are made within the spirit and the tenor of the accompanying claims.

I claim:

1. A safety base component for a scaffold, said component comprising a main elongate rigid member of a length sufficient to extend between end frame members of the scaffold, safety legs located near end portions of said component, short, elongate rigid members affixed to the ends of said main rigid member and extending outwardly therefrom in a common direction, additional safety legs located at outer end portions of said short rigid members, and attaching means at end portions of said component to enable said component to be detachably connected to lower portions of the scaffold.

2. A safety base component according to claim 1 wherein said safety legs have adjustable means whereby lower ends thereof can be located just above a surface on which the scaffold is supported.

3. A safety base component according to claim 1 wherein an upright tube is located near each end of the component, each of said safety legs has a shank extending through one of said upright tubes, and a locking pin is engageable with each of the upright tubes and the corresponding shank for changing the position of the shank longitudinally in the upright tube.

4. A safety base component according to claim 1 wherein said attaching means comprises slide bars supported by said main rigid member and positioned to engage end frame members of the scaffold.

5. A safety base component for a scaffold, said component comprising a main elongate rigid member, a first short elongate rigid member affixed to one end of said main elongate member and extending transversely therefrom, a second short elongate rigid member affixed to the other end of said main elongate member and extending transversely therefrom, a first upright tubular member affixed to said main elongate member near one end thereof, a second upright tubular member affixed to said main elongate member near the other end thereof, a third upright tubular member affixed to said first short elongate member, a fourth upright tubular member affixed to said second short elongate member, a safety leg for each of said tubular members and comprising a shank received in the tubular member and a foot at the lower end thereof, each of said shanks and said tubular members having adjusting means to enable the shank to be vertically adjusted in the tubular member, and attaching means at each end of said component to enable said component to be detachably connected with the lower portions of the scaffold.

6. A safety base compononent according to claim 5 wherein each of said tubular members has aligned holes therein, each of said shanks has a plurality of uniformly-spaced holes therein, and a locking pin for each of said tubular members and extending through said holes in said tubular member and at least one hole in said shank.

7. A safety base component according to claim 6 wherein each of said locking pins has spring means for urging said pin toward said shank.

8. A safety base component according to claim 5 wherein said attaching means comprises a support located at each end of said main rigid member and a slide bar slidably supported by each of said supports and extendable outwardly therefrom.

9. In combination, a scaffold comprising two end frames, each having two vertical frame members and a lower horizontal frame member, and cross braces connecting the vertical frame members of the end frames, a safety base for said scaffold comprising two components, each of said components comprising a main elongate rigid member of a length sufficient to extend between said end frame members of the scaffold, safety legs located near end portions of said component, and attaching means at end portions of said component to enable said component to be detachably connected to the lower horizontal frame members of said end frames.

10. The combination according to claim 9 wherein said end frames have casters for supporting said scaffold on a surface and said safety legs have lower ends positioned just above the surface.

11. The combination according to claim 9 wherein a first short elongate rigid member is affixed to one end of said main elongate member of each of said components and extends transversely therefrom, a second short elongate rigid member is affixed to the other end of said main elongate member of each of said components and extends transversely therefrom, and additional safety legs are located near end portions of said short elongate rigid members.

12. The combination according to claim 9 wherein an upright tubular member is affixed near each end of each of said components, each of said safety legs has a shank received in a corresponding one of said tubular members and has a foot at the lower end thereof, and each of said tubular members has adjusting means to enable the shank to be vertically adjustable in the tubular member.

13. The combination according to claim 9 wherein said attaching means comprise slide bars extendable into engagement with the lower frame members of said end frames.

* * * * *